US007108039B2

(12) United States Patent
Nien

(10) Patent No.: US 7,108,039 B2
(45) Date of Patent: Sep. 19, 2006

(54) SLAT STRUCTURE

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 67 days.

(21) Appl. No.: 10/805,301

(22) Filed: Mar. 22, 2004

(65) Prior Publication Data

US 2005/0126722 A1 Jun. 16, 2005

(30) Foreign Application Priority Data

Dec. 10, 2003 (TW) ..... 92221713 U

(51) Int. Cl.
*E06B 3/06* (2006.01)

(52) U.S. Cl. ..... 160/236

(58) Field of Classification Search ..... 160/236, 160/84.04, 89, 168.1 R
See application file for complete search history.

(56) References Cited

U.S. PATENT DOCUMENTS 2,304,534 A * 12/1942 Burns ..... 160/173 R
5,165,460 A * 11/1992 Guthrie ..... 160/176.1 V
5,313,999 A * 5/1994 Colson et al. ..... 160/121.1
6,105,657 A * 8/2000 Zorbas ..... 160/236
6,378,567 B1 * 4/2002 Chen ..... 139/383 R
6,854,504 B1 * 2/2005 Nien ..... 160/176.1 R
6,880,611 B1 * 4/2005 Nien ..... 160/236
2003/0019589 A1 * 1/2003 Colson et al. ..... 160/84.06
2005/0121149 A1 * 6/2005 Shih et al. ..... 160/236

* cited by examiner

*Primary Examiner*—Blair M. Johnson
(74) *Attorney, Agent, or Firm*—Troxell Law Office, PLLC

(57) ABSTRACT

A slat structure includes a plurality of support sticks integrally woven with a woven fabric into a piece of decoration article wherein the support sticks are equidistantly wrapped in place by the woven fabric, and an adhesive layer is coated at the upper and lower surfaces of the decoration article thereon respectively, securely binding the woven fabric and the support sticks thereby to form a hard and solid piece of the decoration article which is then laterally or vertically dissevered in equal distance into specific horizontal-type or vertical-type slat pieces. Thus, via the weaving of the woven fabric, the slat pieces thereof are equipped with artistic diagrams of rich colors and three-dimensional designs at the upper and lower surfaces thereon. Besides, the woven fabric, securely hold by the supported sticks and further bound by the adhesive layer, can efficiently avoid the loose yarns in cutting operation thereof, preventing the slat pieces from coming or wearing off after long time of repeated friction in use so that the upper and lower surfaces of the slat pieces thereof can be precisely protected by the adhesive layers coated thereon to achieve longer using lifespan of the slat pieces thereof.

7 Claims, 7 Drawing Sheets

SLAT STRUCTURE

BACKGROUND OF THE INVENTION

The present invention is related to a slat structure, including a plurality of support sticks integrally woven with a woven fabric into a piece of decoration article wherein the support sticks are equidistantly wrapped in place by the woven fabric, and an adhesive layer is coated at the upper and lower surfaces of the decoration article thereon respectively, securely binding the woven fabric and the support sticks thereby to form a hard and solid piece of the decoration article which is then laterally or vertically dissevered in equal space into specific horizontal-type or vertical-type slat pieces; whereby, via the woven fabric, the slat pieces thereof are equipped with artistic weaving diagrams of rich colors and three-dimensional designs at the upper and lower surfaces thereon; besides, the woven fabric, securely hold by the supported sticks and protected by the adhesive layer, can efficiently avoid the loose yarns in cutting operation thereof, precisely preventing the slat pieces from coming or wearing off after long time of repeated friction in use to achieve longer using lifespan of the slat pieces thereof.

Please refer to FIGS. 1 to 2 inclusive. Conventional horizontal-type and vertical-type slat pieces 1, 1' are molded via plastics into elongated and slim solid color slat pieces of sufficient strength and hardness before diagrams 2, 2' are printed or hot-pressed onto the surfaces of the horizontal-type and vertical-type slat pieces 1, 1' respectively. Finally, cord passage holes, 3, 3' are punched at the slat pieces 1, 1' thereon for retaining cords to be led there-through.

There are some drawbacks to the above conventional slat structures. First, the horizontal-type and vertical-type slat pieces 1, 1', made of plastics, must be individually formed via injection molding, which is complex in the process and thus unable to be quickly produced on a massive scale. Besides, the slat pieces 1, 1' must be further processed via printing or hot-pressing to apply the diagrams 2, 2' onto the surfaces thereof, which may boost the cost of production and is rather uneconomical in efficiency. Second, after long time of repeated friction of the slat pieces 1 in use, 1'thereof, the diagrams 2, 2' printed thereon can easily come or wear off, which not only mars the overall beauty of the blinds, but also reduces the using lifespan of the slat pieces thereof. Third, the horizontal-type and vertical type slat pieces 1, 1', made of plastics, can increase the burden of the environment in recycle. When burned off in disposal, the slat pieces 1, 1' thereof can also cause air pollution and harm the environment.

SUMMARY OF THE PRESENT INVENTION

It is, therefore, the primary purpose of the present invention to provide a slat structure, including a plurality of support sticks integrally woven with a woven fabric into a piece of decoration article, and an adhesive layer coated at the upper and lower surfaces of the decoration article thereon respectively, securely binding the woven fabric and the support sticks thereby to form a hard and solid piece of the decoration article which is then laterally or vertically dissevered in equal distance into specific horizontal-type or vertical-type slat pieces with various and colorful weaving diagrams disposed thereon, facilitating a fast and easy processing thereof so as to reduce the cost of production and achieve economical efficiency thereof.

It is, therefore, the second purpose of the present invention to provide a slat structure wherein, via the woven fabric, the slat pieces thereof are equipped with artistic weaving diagrams of rich colors and three-dimensional designs at the upper and lower surfaces thereon; besides, the woven fabric, securely hold by the supported sticks and further protected by the adhesive layer at the upper and lower surfaces thereon, can efficiently avoid the loose yarns in cutting operation thereof, precisely preventing the slat pieces from coming or wearing off after long time of repeated friction in use to achieve longer using lifespan thereof.

It is, therefore, the third purpose of the present invention to provide a slat structure wherein, via the support sticks made of bamboo materials, the woven fabric, and the adhesive layer of food-used fastening agent, the slat pieces are easily disposed in recycle or burning off without causing any burden or air pollution to the environment to provide an eco-friendly slat pieces thereof.

DETAILED DESCRIPTION OF THE PREFERRED EMBODIMENTS

Figure 1:
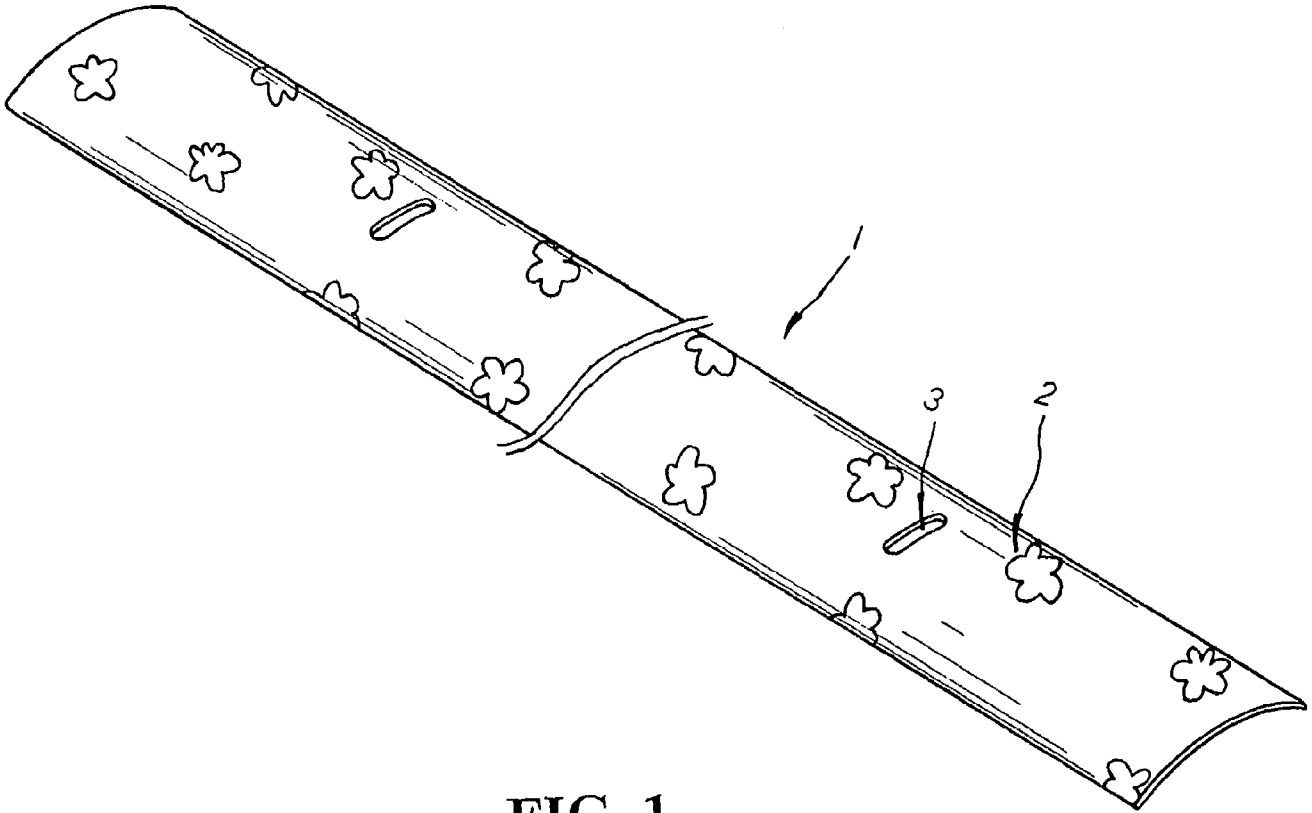
FIG. 1 PRIOR ART
FIG. 1 is a perspective view of a conventional horizontal-type slat piece.
Figure 2:
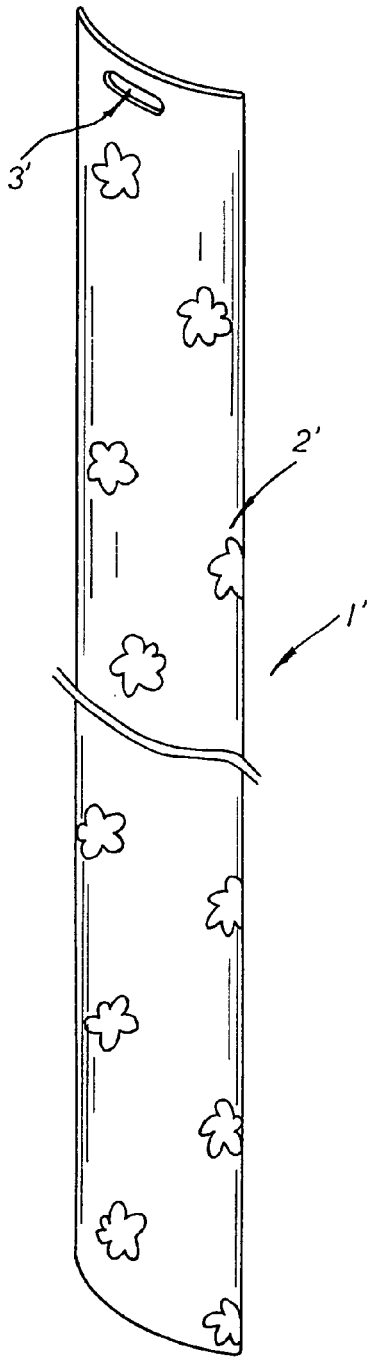
FIG. 2 PRIOR ART
FIG. 2 is a perspective view of a conventional vertical-type slat piece.
Figure 3:
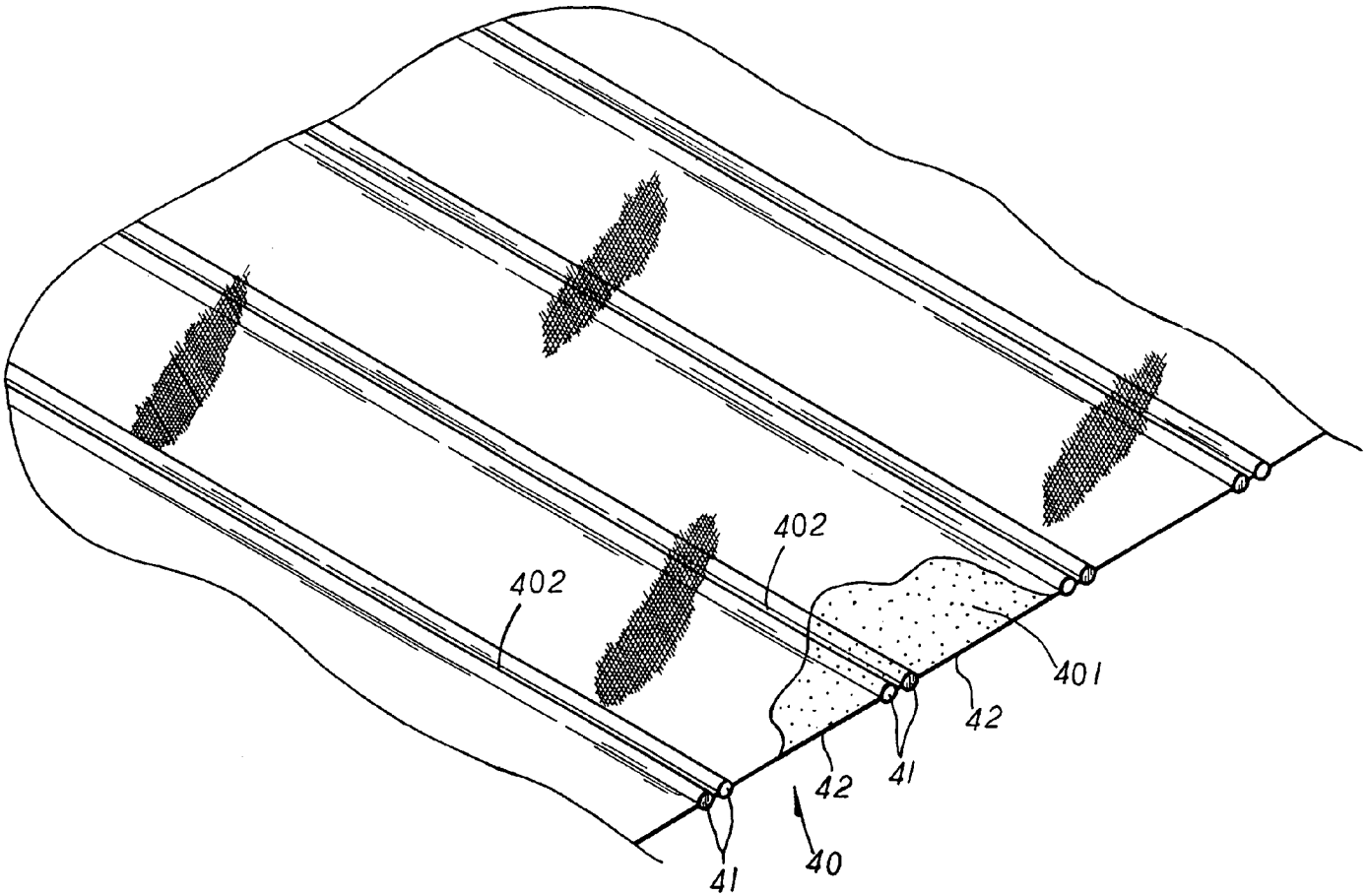
FIG. 3 is a perspective view of a decoration article of the present invention.
Figure 4:
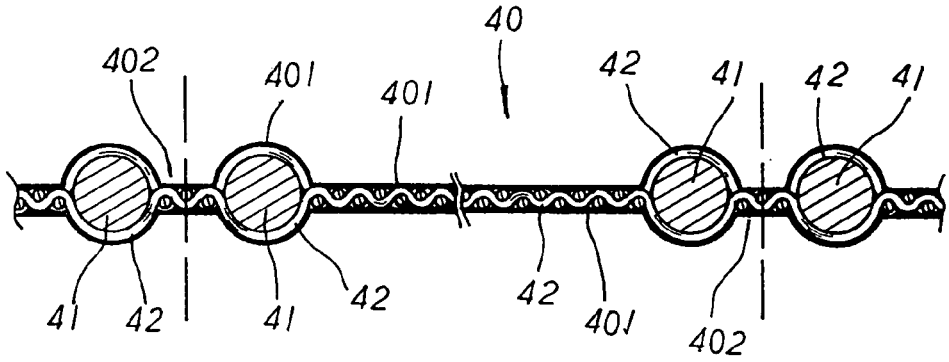
FIG. 4 is a cross sectional view of the present invention in cutting operation.
Figure 5:
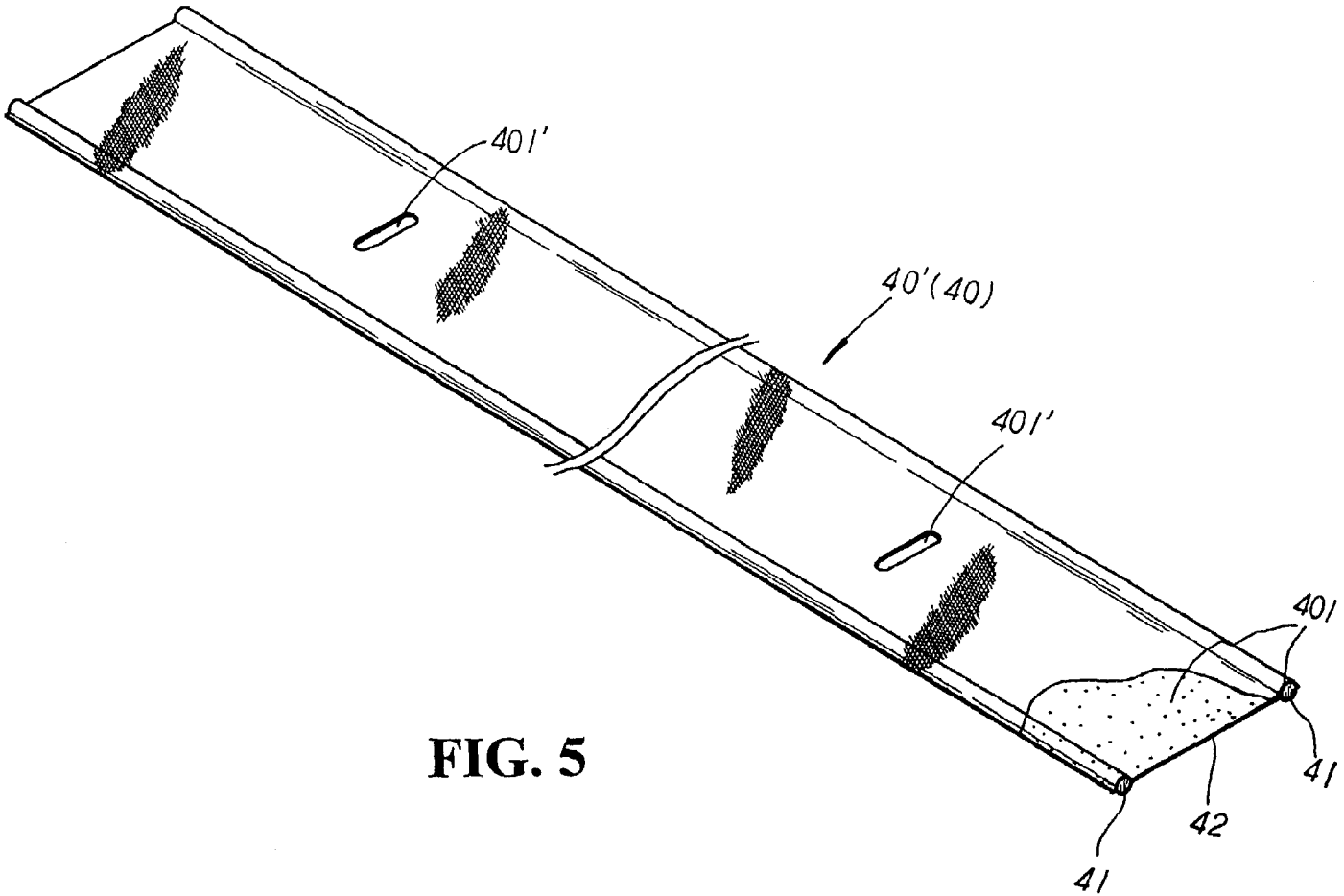
FIG. 5 is a perspective view of a horizontal-type slat piece of the present invention.

Please refer to FIGS. 3 to 5 inclusive. The present invention is related to a slat structure, comprising a plurality of support sticks 41 of bamboo materials equidistantly arranged in pairs and integrally woven with a woven fabric 42 into a piece of decoration article 40. The paired-up support sticks 41 are thus wrapped in place by the woven fabric 42 in equal distance. A food-used and transparent adhesive layer 401 is coated at the upper and lower surfaces of the decoration article 40 thereon respectively, securely binding the woven fabric 42 and the support sticks 41 thereby to form a hard and solid piece of the decoration article 40 thereof. A slim and elongated cutting area 401 is disposed between each pair of the support sticks 41 thereof, and diagrams of various designs are integrally woven at the surfaces of the decoration article 40 thereon. The decoration article 40 thereof is then laterally and equidistantly severed along cutting areas 401 of the support sticks 41 thereof to form a plurality of specific horizontal-type slat pieces 40 as shown in FIG. 5. A cord passage hole 401 is properly disposed at each lateral surface of the horizontal-type slat piece 40 thereon for a retaining cord to be led there-through. Thus, via the woven fabric 42, the horizontal-type slat piece 40 is equipped with artistic weaving diagrams of rich colors and three-dimensional designs at the upper and lower surfaces thereon. Besides, the woven fabric 42 is securely hold by the supported sticks 41 and further bound by the adhesive layer 401 coated at the surfaces thereon, efficiently avoiding the loose yarns in cutting operation thereof. The horizontal-type slat pieces 40 is then prevented from coming or wearing off after long time of repeated friction in use and precisely protected by the adhesive layers 40 coated at the upper and lower surfaces thereon so as to achieve longer using lifespan of the slat pieces 40 thereof.

Figure 7:
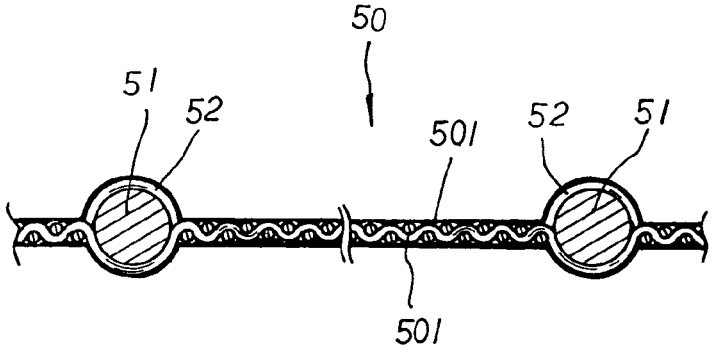
FIG. 7 is a cross sectional view of another embodiment of the present invention.
Figure 6:
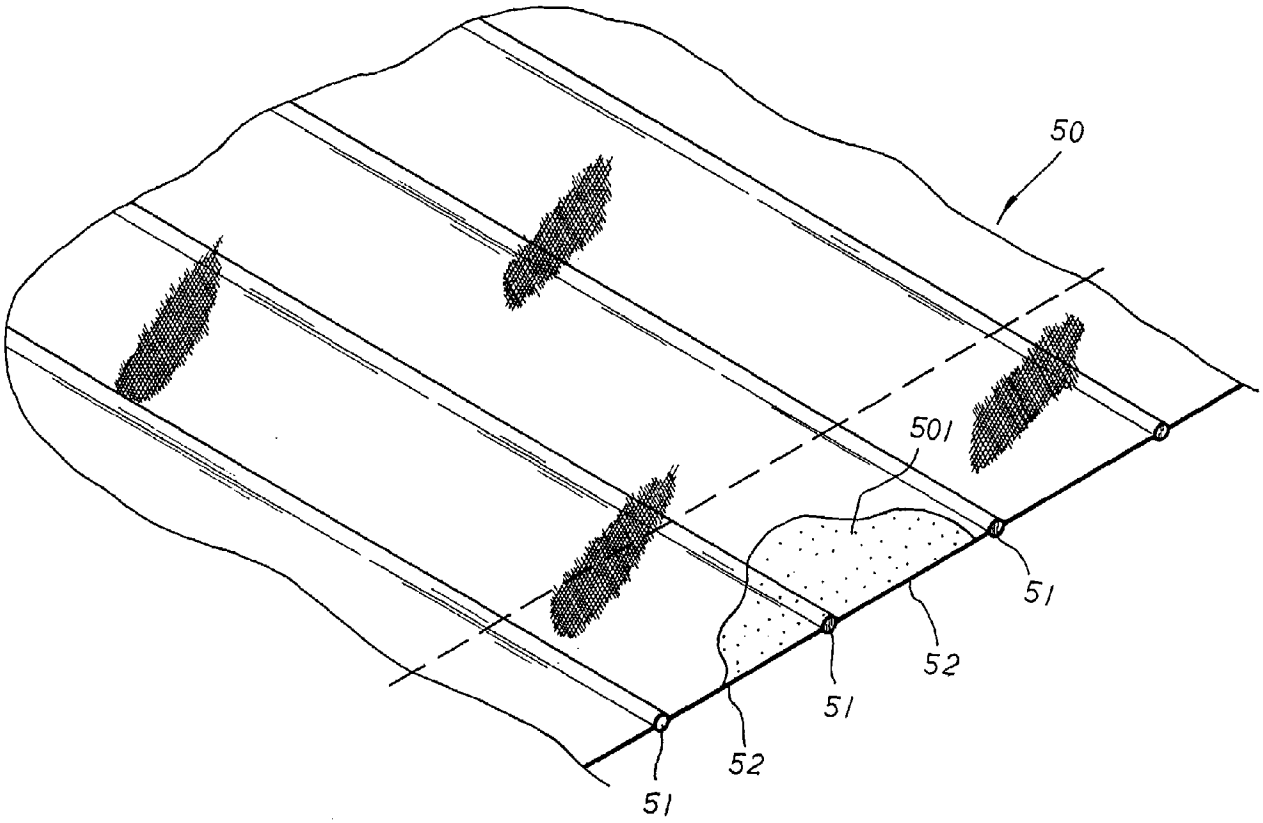
FIG. 6 is a perspective view of a decoration article of another embodiment of the present invention.
Figure 8:
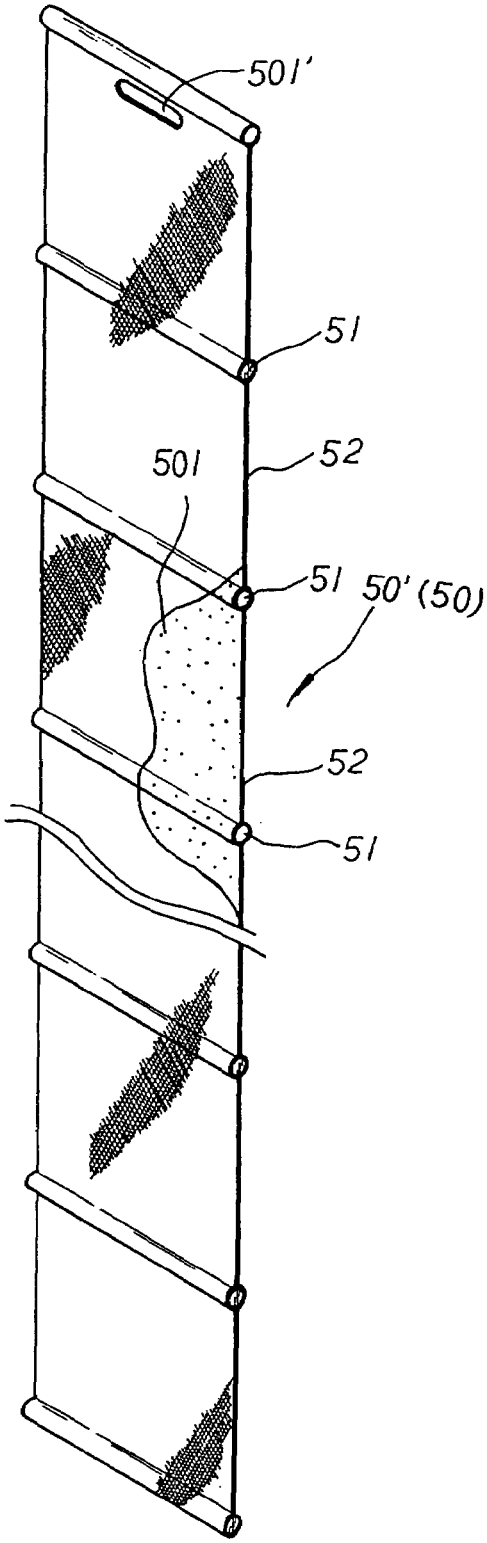
FIG. 8 is a perspective view of a vertical-type slat piece of another embodiment of the present invention.

Please refer to FIGS. 6 to 8 inclusive. The present invention can also includes a plurality of support sticks 51 individually arranged in equal space and integrally woven with a woven fabric 52 into a piece of decoration article 50. The support sticks 51 are equidistantly wrapped in place by the woven fabric 52 thereof, and a adhesive layer 501 is coated at the upper and lower surfaces of the decoration article 50 thereof respectively, securely binding the woven fabric 52 and the support sticks 51 thereby to form a hard and solid piece of the decoration article 50 thereof. The decoration article 50 is then vertically and equidistantly dissevered into a plurality of specific vertical-type slat pieces 50' each having a hook hole 501' properly preset at one lateral side thereon as shown in FIG. 8. Thus, via the weaving of the woven fabric 52 thereof, the vertical-type slat pieces 50' are equipped with artistic diagrams of rich colors and three-dimensional designs.

What is claimed is:

1. A slat structure comprising:

a) a decorative article having:

i) a woven fabric having artistic designs integrally woven therein; and ii) at least two support sticks integrally woven into the decorative article by the woven fabric; and b) a transparent adhesive layer coating each of two opposing outer surfaces of the decorative article adhering the woven fabric and the at least two support sticks together and forming a rigid structure.

2. The slat structure according to claim 1, wherein the at least two support sticks are made of baboo materials.

3. The slat structure according to claim 1, wherein the at least two support sticks are equally spaced apart.

4. The slat structure according to claim 1, where the at least two support sticks extend parallel to a length of the decorative article.

5. The slat structure according to claim 4, wherein a cord passage hole is located in each of two opposing ends thereof.

6. The slat structure according to claim 1, where the at least two support sticks extend perpendicular to a length of the decorative article.

7. The slat structure according to claim 6, wherein a hook hole is located in one of two opposing ends thereof.

* * * * *